US005249985A

United States Patent [19]

Obenauer

[11] Patent Number: 5,249,985

[45] Date of Patent: Oct. 5, 1993

[54] FUSE HOLDER ADAPTER

[75] Inventor: Kenneth Obenauer, Massapequa, N.Y.

[73] Assignee: New York Telephone Company, New York, N.Y.

[21] Appl. No.: 778,323

[22] Filed: Oct. 16, 1991

[51] Int. Cl.[5] ..... H01R 33/95

[52] U.S. Cl. ..... 439/621

[58] Field of Search ..... 439/621, 622, 698; 337/208-210, 216, 254

[56] References Cited

U.S. PATENT DOCUMENTS

| | | | |
|---|---|---|---|
| 1,724,729 | 8/1929 | Ruttenberg et al. | 439/828 |
| 3,486,154 | 12/1969 | Seagrave et al. | 439/622 |
| 3,744,003 | 7/1973 | Dipace | 439/621 |
| 3,753,216 | 8/1973 | Johnson et al. | 439/491 |
| 5,116,246 | 5/1992 | Perry et al. | 439/621 |

*Primary Examiner*—Gary F. Paumen

*Attorney, Agent, or Firm*—Loren Swingle; John J. Torrente

[57] ABSTRACT

A fuse holder adapter for use with knife-blade fuse clips used with standard 600 ampere fuses in which the adapter comprises first and second metallic plates mounted in facing, spaced relationship on an insulator plate. The first and second metallic plates have respective first and third sections which are adapted to receive fuse clips to form fuse holders of different length and further have respective second and fourth sections formed as knife-blades and extending beyond the insulator plate so as to be able to be receivable in the knife-blade fuse clips used with the standard 600 ampere fuses.

17 Claims, 2 Drawing Sheets

FUSE HOLDER ADAPTER

BACKGROUND OF THE INVENTION

This invention relates to fuse holders and, in particular, to fuse holders for use in telephone central offices.

Telephone central offices employ fuses in various load circuits for load protection. Many of these fuses are high ampere, i.e., 600 ampere fuses, which were necessary to accommodate the high ampere circuits in the original central office equipment. Also, because of their high ampere rating, these fuses are physically large and of considerable length as measured between the knife-blade ends of the fuses.

To connect the 600 ampere fuses in the various central office load circuits, the central office equipment includes for each fuse, a pair of knife-blade receiving fuse clips. These fuse clips are fixed to the equipment at a predetermined spacing dictated by the fuse length which, as mentioned above, is considerable.

Over the years much of the original central office equipment has been replaced by lower ampere equipment. As a result, it has been found that, in many cases, the 600 ampere fuses are no longer necessary for the new equipment. Also, the presence of the 600 ampere fuses tends to mask current conditions in the lower ampere equipment which should be responded to.

Accordingly, it has been proposed to replace the 600 ampere fuses with lower ampere fuses. Unfortunately, the lower ampere fuses are of much shorter length than the 600 ampere fuses and, hence, are not compatible with the spacing between the existing knife blade receiving fuse clips. To replace the existing 600 ampere fuses with the lower ampere fuses would, therefore, require repositioning and possibly replacing the existing knife-blade receiving fuse clips which is a time consuming and costly process.

It is, therefore, an object of the present invention to provide a fuse holder adapter which permits lower ampere fuses to be used with existing knife-blade receiving fuse clips used for 600 ampere fuses in telephone central office equipment.

It is a further object of the present invention to provide a fuse adapter as set forth in the first objective and which can accommodate a wide range of lower ampere fuses.

It is yet a further object of the present invention to provide a fuse holder adapter as set forth in the above objectives and which is inexpensive and easy to fabricate.

SUMMARY OF THE INVENTION

In accordance with the principles of the present invention, the above and other objectives are realized in a fuse holder adapter comprising first and second metallic plates. The first metallic plate has a first section which has first and second positions for supporting first and second fuse clips at first and second spaced distances from a first end of the plate. The first plate also includes a second section integral with the first section and formed as a knife-blade, i.e., as a first predetermined end.

The second metallic plate is of like design and has a third section which has third and fourth positions for supporting third and fourth fuse clips at third and fourth distances from a third end of the plate. A fourth section of the second plate is integral with the third section and is also formed as a knife blade, i.e., as a second predetermined end.

The fuse holder adapter also includes an insulator plate to which the first and second plates are mounted such that the plates have their first and third ends in spaced, facing relationship and such that the first and third positions of the plates, when occupied by their respective fuse clips, define a first fuse holder of first length and the second and fourth positions of the plates, when occupied by their respective fuse clips, define a second fuse holder of second length greater than the first length. The mounting of the first and second plates is also such that the second and fourth knife-blade ends of the plates extend outward of the insulator plate a sufficient distance so as to be receivable in the knife-blade receiving fuse clips used for the 600 ampere fuses in existing telephone central offices. These existing fuse clips define first and second predetermined fuse clips having a first predetermined distance therebetween.

With this configuration for the fuse holder adapter, the adapter can be mounted to the 600 ampere knife blade fuse clips without having to reposition the spacing of these clips. Furthermore, lower ampere fuses can now be mounted in the second defined fuse holder of the adapter and even lower ampere fuses in the first defined fuse holder.

In the embodiment of the invention to be disclosed hereinafter, the first and third positions receive cartridge receiving fuse clips and the second and fourth positions knife-blade receiving fuse clips. The cartridge receiving fuse clips can thus be used for lower ampere fuses and the knife blade receiving fuse clips for higher ampere fuses. Also, in this embodiment, the attachment means used for attaching the fuse clips to the first and second plates is also used to mount the plates to the insulator member. Furthermore, in the disclosed embodiment, an insulator insert is held between the first and second ends of the metallic plates and supported on the insulator plate.

BRIEF DESCRIPTION OF THE DRAWINGS

The above and other features and aspects of the present invention will become more apparent upon reading the following detailed description in conjunction with accompanying drawings, in which.

DETAILED DESCRIPTION

Figure 1:
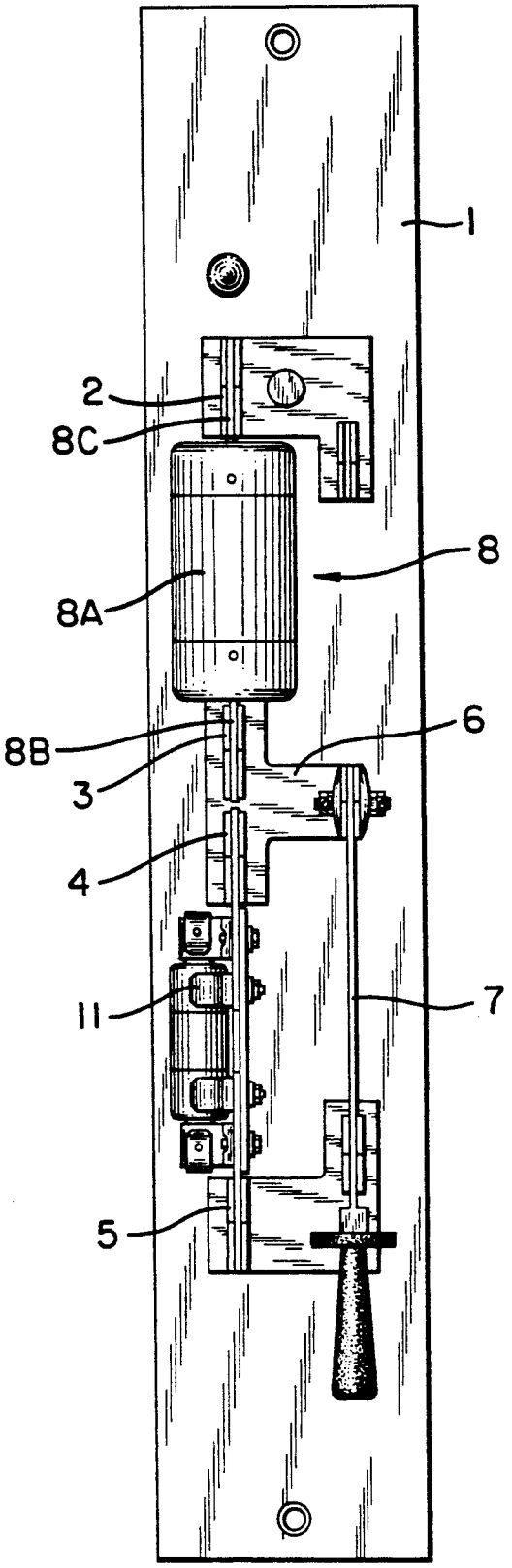
FIG. 1 shows telephone central office equipment utilizing a fuse holder adapter in accordance with the principles of the present invention.

In FIG. 1, an equipment rack 1 of a telephone central office is shown. The rack 1 is provided with externally mounted knife-blade receiving fuse clips 2, 3, 4 and 5 for mounting fuses to the equipment for current protection. As shown, the fuse clips 3 and 4 are on a common mounting 6.

The fuse clips pairs 2, 3 and 4, 5 permit the mounting of two fuses to the equipment rack 1, only one of which provides current protection to the equipment at a time. A shorting bar 7 is connected across the pair of fuse clips whose fuse is not to provide protection. The shorting bar 7 is pivotably attached to the common mounting 6 so that it can be swung from connecting the pair of clips 2, 3 to connecting the pair of clips 4, 5, respectively.

The pairs of clips 2, 3 and 4, 5 are further spaced such that each pair can receive a standard 600 ampere fuse. In the case shown, a 600 ampere fuse 8 having a fuse body 8A and knife blade ends 8B and 8C is connected between the fuse clips 2 and 3. A typical 600 amp fuse 8 might be the fuse manufactured by Buss and sold under the name NON-600.

As above-discussed, where the equipment in the rack 1 has been replaced by newer equipment not requiring 600 ampere fuse protection, it is beneficial to replace the 600 ampere fuses with smaller ampere fuses. However, since such fuses are smaller in length than the 600 ampere fuses, they cannot be directly installed between the existing knife-blade receiving fuse clips 2, 3 and 4, 5.

In accordance with the principles of the present invention, a fuse holder adapter 11 is provided which allows such smaller ampere fuses to be connected to the existing fuse clips. In the case illustrated in FIG. 1, the adapter 11 is shown as being used to connect a lower ampere fuse between the pair of knife-blade receiving clips 4 and 5. In practice, a like adapter carrying a fuse would also be used to replace the top 600 ampere fuse 8.

Figure 2:
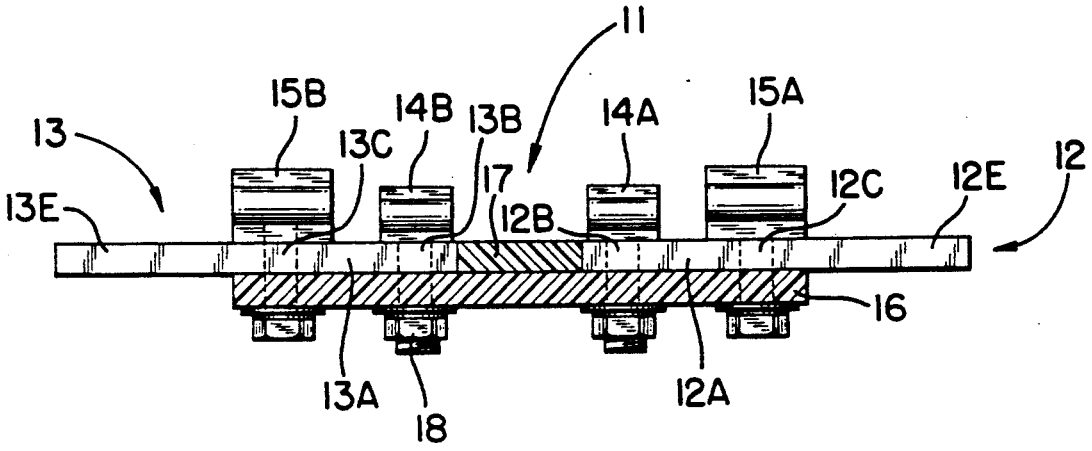
FIG. 2 shows a side view of the fuse holder adapter shown in FIG. 1.
Figure 3:
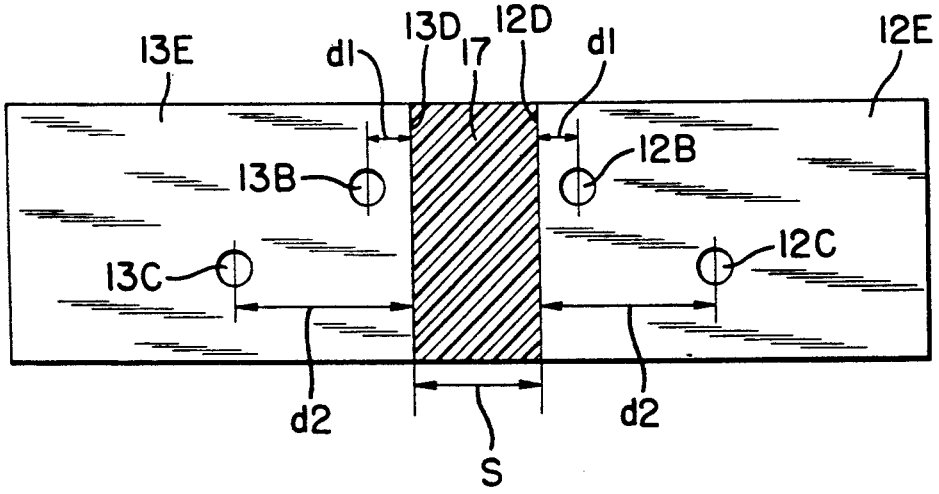
FIG. 3 shows a top plan view of the fuse holder adapter of FIG. 1 with the fuse clips removed.

As shown in more detail in FIG. 2, the adapter 11 includes first and second metallic plates 12 and 13. These plates have first sections 12A, 13A which support at positions 12B, 12C and 13B, 13C fuse clips 14A, 15A and 14B, 15B. The positions 12B and 13B are spaced at a first distance d1 from their respective plate edges 12D and 13D, while the positions 12C and 13C are spaced at a second distance d2 greater than d1 from these edges.

The plates 12 and 13 are further supported on an insulator plate 16. The plate 16 supports the plates 12 and 13 such that the edges 12D and 13D of the sections 12A and 13A in are in facing, spaced relationship. In particular, the spacing S between the plates is selected such that the end sections 12E and 13E of the plates extend beyond the insulator plate 1 to form knife-blades ends which ar spaced sufficiently apart to be receivable in each of the pairs of knife-blade receiving fuse clips 2, 3 and 4, 5.

When supported on the plate 16, the metallic plates 12 and 13 are further arranged such that the fuse clips 14A and 14B define a first fuse holder of a first length (i.e., approximately S+2d1) and the fuse clips 15A and 15B define a second fuse holder of a second length (i.e., approximately S+2d2) greater than the first length. Accordingly, a fuse of a first length and first ampere rating (less than the previous 600 ampere rating) can now be supported between the fuse clips 14A, 14B, while a fuse of a second length and second ampere rating greater than the first length and ampere rating, respectively, (but also less than the previous 600 ampere rating) can now be supported between the clips 15A, 15B.

As can be appreciated, the adapter 11 can be mounted between the knife-blade fuse clips 2, 3 and 3, 4 without having to change the existing position of the clips. Also fuses of lower ampere rating than 600 amperes can now be supported on the adapter so that these lower ampere fuses can serve as current protection for the equipment 1.

In the case shown, the adapter 11 also includes an insulator insert 17 mounted on the insulator plate 16 and held between the plate ends 12D and 13D. The insert 17 further acts to electrically insulate the plates 12 and 13 from each other.

Also, in the case shown, the mountings 18 used to mount the respective fuse clips 14A, 14B, 15A, 15B are likewise used to connect the metallic plates 12 and 13 to the main insulator plate 16. Additionally, the clips 14A, 14B are shown as knife-blade receiving fuse clips and, thus, are able to accommodate fuses of larger capacity, e.g., 100 amps, which usually have knife-blade ends. The fuse clips 13A, 13B, on the other hand, are shown as cartridge receiving fuse clips and, hence, able to accommodate fuses of smaller capacity, e.g., 60 amps and below, which generally have cylindrical or cartridge-type ends. In use, only one of the two sets of clips 13A, 14A or 13B, 14B would hold a fuse.

In the actual fabrication of the adapter 11, the plates 12 and 13 may each comprise copper. The insulator plate 16 and insert 17, in turn, can each comprise plexiglass. It should also be noted that fuses of very low amperage (e.g., tenths of an ampere) can also be used with the adapter 11. In some cases, a low ampere fuse may itself have to be held in a mounting which can then be recieved in one of the fuse clip parts of the adapter 11.

In all case it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claim is:

1. A multiple fuse adapter for use with first and second predetermined fuse clips spaced at a first predetermined distance from one another, the multiple fuse adapter comprising:

first and second metallic plates;

an insulator plate;

said metallic plates being mounted on said insulator plate such that the metallic plates lie in a plane, separated by a distance sufficient that one edge portion of each metallic plate is engageable with one of said predetermined fuse clips and that the metallic plates are electrically isolated from each other, with a further portion of the edge of one metallic plate facing a further portion of the edge of the other metallic plate, said further edge portions forming a pair of opposing edge portions;

a plurality of fuse clip pairs, respective clips of said fuse clip pairs being each affixed to respective ones of the metallic plates such that the clips of at least one of the fuse clip pairs are spaced from each other at a distance different from that separating the clips of another such fuse clip pairs, said fuse clip pairs constituting a plurality of fuse holders.

2. A multiple fuse adapter in accordance with claim 1 wherein:

said first and second predetermined fuse clips are knife-blade receiving fuse clips, and are separated at a distance sufficient to receive standard 600 ampere fuses in existing telephone central office equipment; and said pairs of metallic plates are such that each has one edge portion formed as a knife-blade edge engageable with said predetermined fuse clips.

3. A multiple fuse adapter in accordance with claims 1 or 2 wherein:

a first of said fuse holders is adapted to hold a fuse of a lower ampere rating than a second of said fuse holders.

4. A multiple fuse adapter in accordance with claims 1 or 2 wherein:

each fuse clip of said one fuse clip pair is a cartridge receiving fuse clip;

and each fuse clip of said another fuse clip pair is a knife-blade receiving fuse clip.

5. A multiple fuse adapter in accordance with claims 1 or 2 further comprising:

common mounting means for mounting said respective fuse clips corresponding to said first and second plates and said first and second plates to said insulator plate.

6. A multiple fuse adapter in accordance with claims 1 or 2 wherein:

said plurality of fuse holders each being adapted to hold fuses of an ampere capacity less than 600 amperes.

7. A multiple fuse adapter in accordance with claims 1 or 2 wherein:

said insulator plate comprises a plexiglass material.

8. A multiple fuse adapter in accordance with claims 1 or 2 further comprising:

an insulator insert supported on said insulator plate such as to occupy the space between said opposing edge portions of said first and second metallic plates.

9. A multiple fuse adapter in accordance with claim 8 wherein:

said insulator plate and said insulator insert each comprise a plexiglass material.

10. A multiple fuse adapter in accordance with claims 1 or 2 wherein:

each of said first and second metallic plates comprises a copper material.

11. A method of fabricating a multiple fuse adapter for use with first and second predetermined fuse clips spaced at a first predetermined distance from one another, the method comprising:

providing first and second metallic plates and an insulator plate;

mounting said metallic plates on said insulator plate such that the metallic plates lie in a plane, separated by a distance sufficient that one edge portion of each metallic plate is engageable with one of said predetermined fuse clips and that the metallic plates are electrically isolated from each other, with a further portion of the edge of one metallic plate facing a further portion of the edge of the other metallic plate, said further edge portions forming a pair of opposing edges; and affixing a plurality of fuse clip pairs to said metallic plates such that one clip of each fuse clip pair is affixed to one of said metallic plates and such that the clips of at least one of the fuse clip pairs are spaced apart at a distance greater than that separating the clips of another of the fuse clip pairs, said fuse clip pairs constituting a plurality of fuse holders.

12. The method of claim 11 further comprising:

forming said first and second predetermined fuse clips as knife-blade receiving fuse clips, and as separated at a distance sufficient to receive standard 600 ampere fuses in existing telephone central office equipment; and forming one edge portion of each of said metallic plates as a knife-blade engageable with said predetermined fuse clips.

13. A method in accordance with claim 11 or 12 further comprising:

forming said one fuse clip pair to receive a knife-blade type fuse and forming said another fuse clip pair to receive a cartridge type fuse.

14. A method in accordance with claims 11 or 12 wherein:

said another clip pair is adapted to hold a fuse of a lower ampere rating that said one fuse clip pair.

15. A method in accordance with claims 11 or 12 wherein:

each of said fuse holders is adapted to hold fuses of an ampere capacity less than 600 amperes.

16. A method in accordance with claim 11 or 12 further comprising:

mounting an insulator insert on said insulator plate such as to occupy the space between said opposing edge portions of said first and second metallic plates.

17. A method accordance with claims 11 or 12 wherein:

said metallic plates each comprise a copper material; and said insulator plate comprises a plexiglass material.

* * * * *